United States Patent [19]

Hart

[11] Patent Number: 4,836,439

[45] Date of Patent: Jun. 6, 1989

[54] MICROWAVE CARTON

[75] Inventor: Joseph J. Hart, Philadelphia, Pa.

[73] Assignee: Container Corporation of America, Clayton, Mo.

[21] Appl. No.: 148,604

[22] Filed: Jan. 26, 1988

[51] Int. Cl.[4] ..... B65D 5/24

[52] U.S. Cl. ..... 229/104; 229/112; 229/120; 229/160; 229/163; 229/169; 229/903; 229/DIG. 14; 426/109; 426/114

[58] Field of Search ..... 229/104, 112, 120, 126, 229/160, 163, 169, 186, 902, 903, 906, DIG. 14; 219/10.55 E; 426/107, 109, 113, 114

[56] References Cited

U.S. PATENT DOCUMENTS

| | | | |
|---|---|---|---|
| 1,105,215 | 7/1914 | Smith et al. | 229/186 |
| 2,016,754 | 10/1935 | Perkit | 229/104 |
| 2,043,104 | 6/1936 | Labombarde | 229/104 |
| 2,781,159 | 2/1957 | Copeman | 229/160 |
| 3,252,650 | 5/1966 | Bryor | 229/186 |
| 3,572,577 | 3/1971 | Dorfman | 229/163 |
| 3,829,004 | 8/1974 | Graser | 229/160 |
| 3,917,155 | 11/1975 | Bemiss | 229/169 |
| 4,230,924 | 10/1980 | Brastad et al. | 426/107 |
| 4,260,060 | 4/1981 | Fuller | 229/120 |
| 4,287,998 | 9/1981 | Zimmerman | 229/120 |
| 4,312,451 | 1/1982 | Forbes, Jr. | 229/169 |
| 4,355,757 | 10/1982 | Roccaforte | 229/104 |
| 4,626,641 | 12/1986 | Brown | 219/10.55 E |

FOREIGN PATENT DOCUMENTS

| | | | |
|---|---|---|---|
| 81991 | 10/1963 | France | 229/120 |
| 1405571 | 5/1965 | France | 229/126 |
| 21232 | of 1913 | United Kingdom | 229/186 |

*Primary Examiner*—Stephen Marcus
*Assistant Examiner*—Gary E. Elkins
*Attorney, Agent, or Firm*—Richard W. Carpenter

[57] ABSTRACT

A disposable, collapsible, sleeve-type, microwave carton, formed from a unitary blank of foldable paperboard, at least partly coated with a discontinuous layer of electrically conductive material, and comprising top, bottom, side and end walls foldably joined to each other, wherein the top wall is substantially wider than the bottom wall and is partially supported by a pair of retaining panels extending laterally from upper edges of the side walls.

1 Claim, 3 Drawing Sheets

MICROWAVE CARTON

BACKGROUND OF THE INVENTION

1. Field of the Invention:

This invention relates to food packaging, and primarily to a paperboard carton adapted for holding a food item and assisting in browning the surface of the item in a microwave oven.

2. Description of Background Art:

A background art search directed to the subject matter of this application conducted in the United States Patent and Trademark Office disclosed the following United States Letters Patent: 4,638,941; 4,612,431; 4,592,914; 4,574,174; 4,255,757; 4,283,427; 4,279,374; 4,260,060; 4,228,945; 4,136,817; 4,096,948.

None of the patents uncovered in the search discloses a disposable, collapsible, sleeve-type, paperboard carton which is partially coated with a discontinuous layer of electrically conductive material and which comprises top, bottom, side and end walls foldably joined to each other, with the top wall being substantially wider than the bottom wall and partially supported by a pair of retaining panels extending laterally from upper edges of the side walls.

SUMMERY OF THE INVENTION

It is an object of the present invention to provide a sleeve-type, paperboard folding carton adapted to hold an article of food and to assist in browning the outer surface of the food when subjected to microwave radiation.

Another object of the invention is the provision of a microwave carton adapted to support a product that is being heated in a microwave oven, and which may be used either as an inner carton within an overwrap or outer carton, or which may be inserted into a package with another carton that actually holds the product.

A more specific object of the invention is the provision of a sleeve-type, paperboard, microwave carton having top, bottom, side, and end walls and additional retaining panels foldably joined to the upper edges of the side walls and adapted to underlie and help support a top wall that is substantially larger in area than the bottom wall.

These and other object of the invention will be apparent from an examination from the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
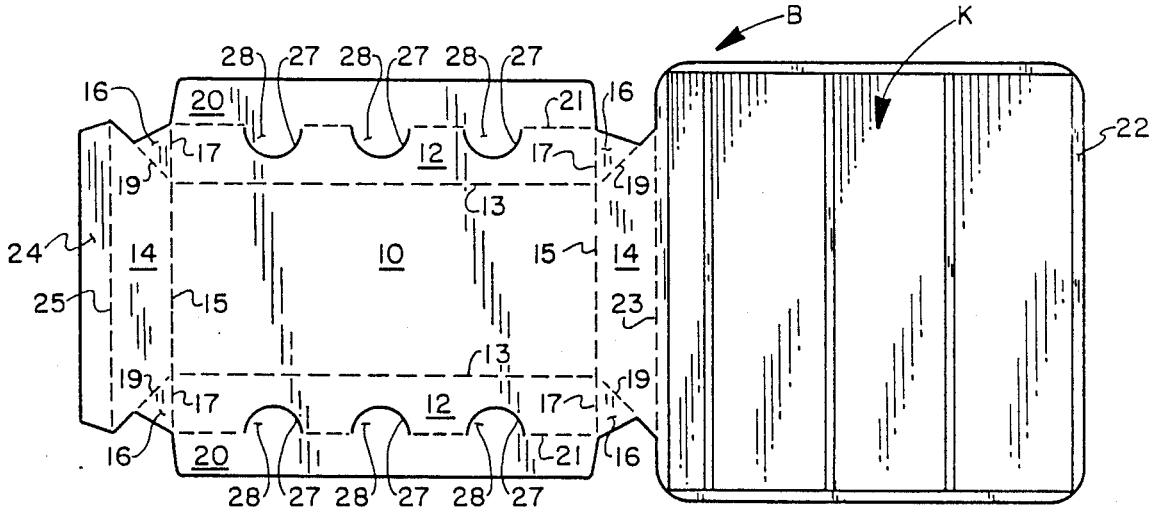
FIG. 1 is a plan view of a blank of foldable paperboard which may be used to form the carton illustrated in the other views.

Referring now to the drawings for a better understanding of the invention, it will be seen that the novel carton embodying features of the invention, and indicated generally at C in FIGS. 2–5, may be formed from a unitary blank of B of foldable sheet material, such as paperboard, illustrated in FIG. 1.

As previously mentioned, the purpose of the carton is to support an article of food while the food is being heated in a microwave oven and to assist in the browning of the surface of the food.

The carton may also be used to enclose the article of food when it initially packaged, or it may be a separate carton included in a package with another carton that actually holds the food product.

Figure 4:
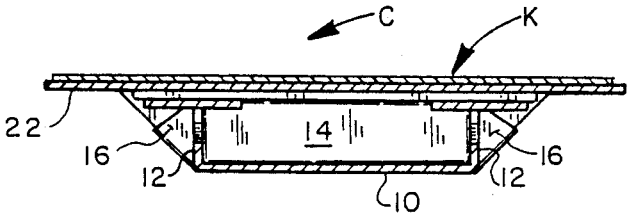
FIGS. 4 and 5 are transverse and longitudinal, vertical, sectional views taken on lines 4—4 and 5—5 of FIGS. 2 and 3, respectively.
Figure 5:
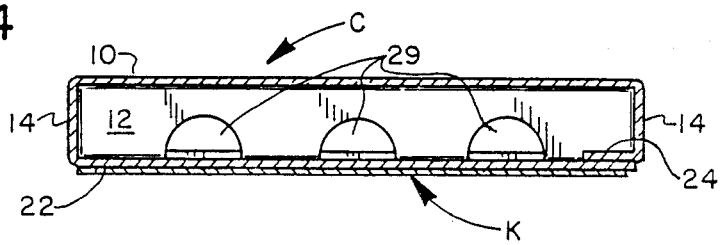
Figure 6:
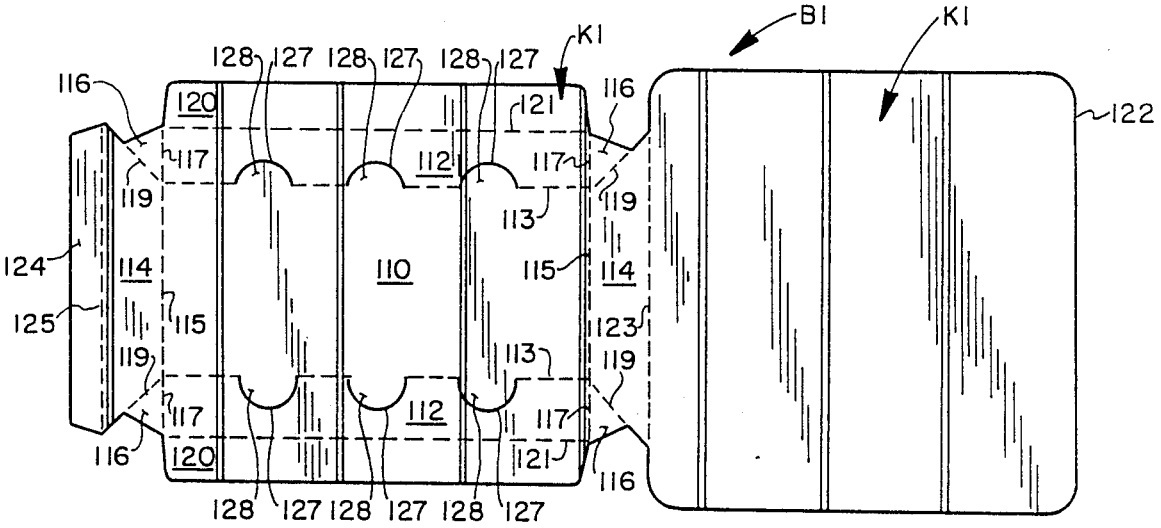
FIGS. 6–10 are views similar to those of FIGS. 1–5, but illustrate a modified form of the invention.
Figure 7:
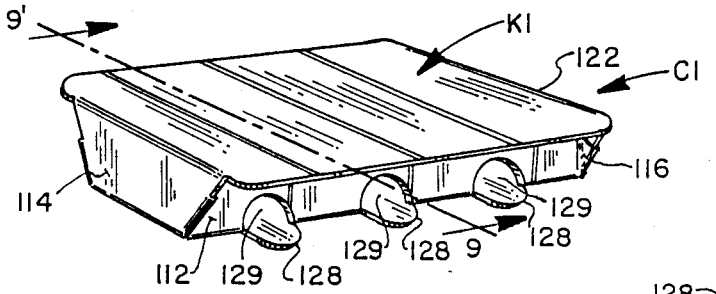
Figure 8:
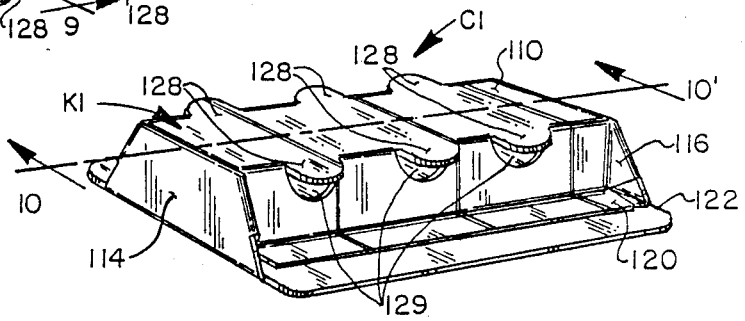
Figure 9:
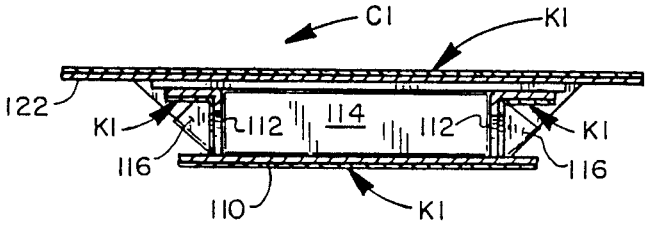
Figure 10:
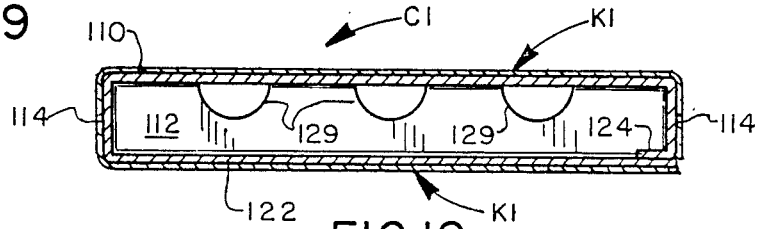
Figure 11:
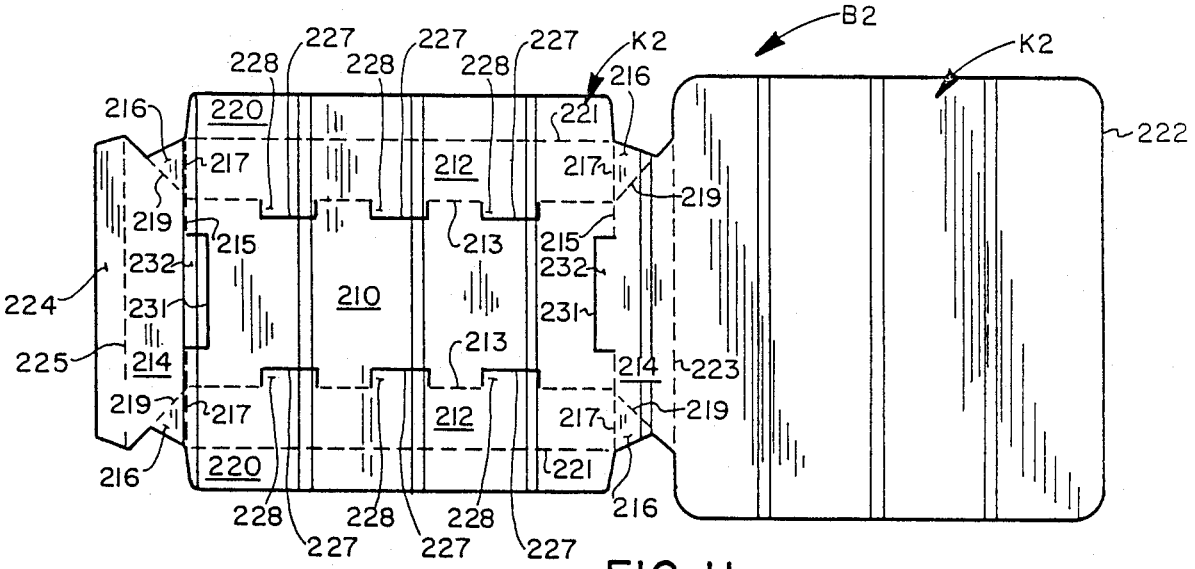
FIGS. 11–15 are also views similiar to those of FIGS. 1–5, but illustrate yet another form of the invention.
Figure 12:
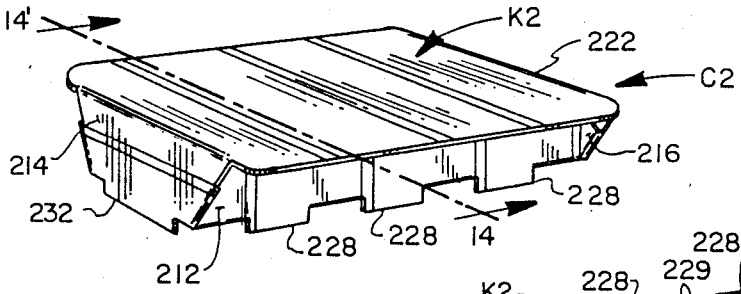
Figure 13:
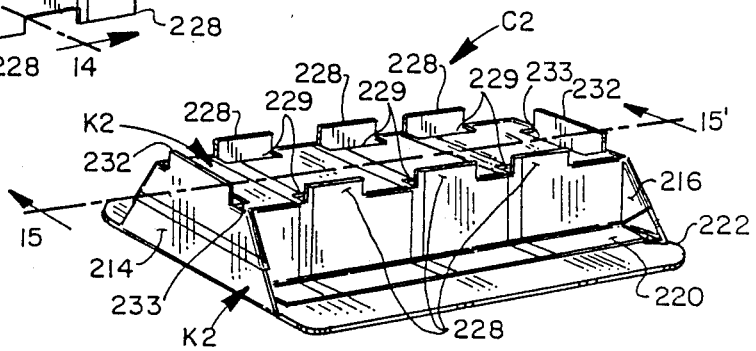
Figure 14:
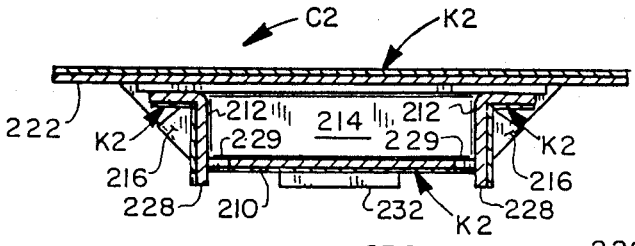
Figure 15:
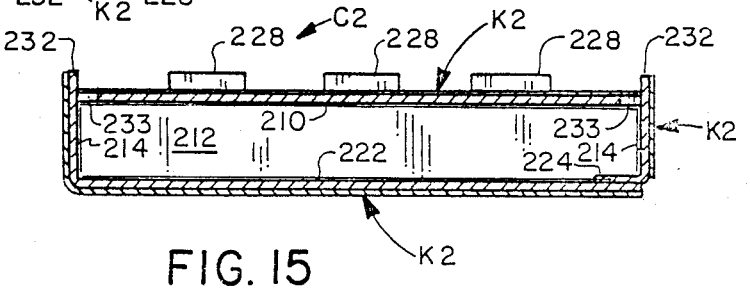

The carton, as best seen in FIGS. 1, 4, and 5, includes a preferably rectangular bottom wall 10 having a pair of opposed side walls 12 foldably joined to opposite side edges thereof along parallel fold lines 13 and having a pair of opposed end walls panels 14 foldably joined to opposed end edges thereof along parallel fold lines 15.

The side walls 12 are joined at opposite ends to end wall 14 by means of generally triangular webs 16, each of which is foldably joined along adjacent edges on fold lines 17 and 19 to the end edge of a related side wall 12 and the side edge of a related end wall 14, respectively.

The carton also includes a top wall 22 which has one end edge foldably joined along fold line 23 to an upper edge of one of the end walls 14 and which may be adhesively secured at its other end edge to a glue flap 24 which is foldably joined along a fold line 25 to an upper edge of the other end wall panel 14.

Figure 2:
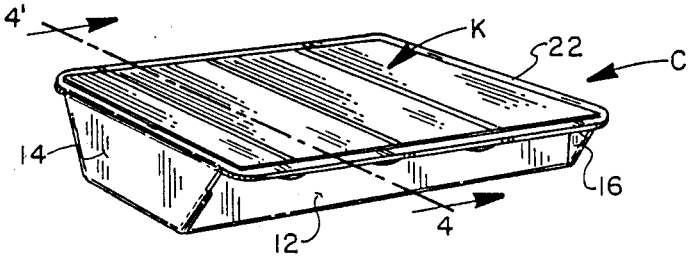
FIG. 2 is a fragmentary perspective view of a carton embodying features of the invention, as shown in its normal upright position.

As best seen in FIGS. 2, 4, and 5, the webs 14 at the corners of the carton are folded against the inner surfaces of related end walls 14, with the side and end walls 12 and 14 extending upwardly from the side and end edges of the bottom wall 10 to support the top wall 22.

In order to provide additional support for the top wall 22, there may be provided a pair of retaining panels 20 which are foldably joined along fold lines 21 to the upper edges of the respective side walls 12 and which are folded at right angles thereto to underlie and offer additional support for top wall 22.

Figure 3:
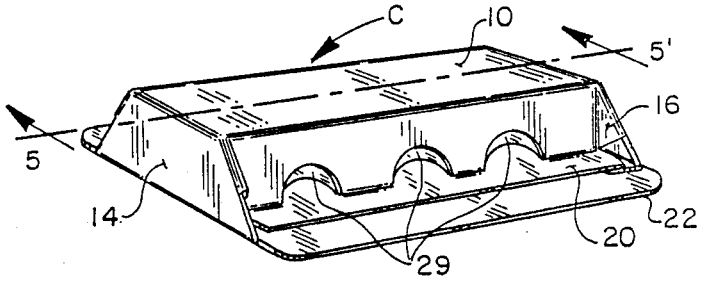
FIG. 3 is a view similar to FIG. 2, but showing the carton in an inverted or upside down position.

Each of the side walls 12 may be provided with a plurality of preferably arcuate cut lines 27, which define tabs 28 and also provide for openings 29, as best seen in FIG. 3.

When the retaining panels 20 are folded at right angles to the side walls, the tabs 28 extend inwardly from the side walls, and the retaining panels extend outwardly to offer additional support for top wall 22.

Also, when the tabs 28 are folded out of the plane of the side walls, openings 29 are formed in the side walls 29. These openings serve as vent openings to permit hot air to escape from inside of the carton when it is used as a support for food in a microwave oven.

In order to facilitate the browning of food placed on the top wall 22, at least one surface of the top wall 22 may be provided with a coating, indicated generally at K, which is preferably a discontinuous layer of conductive material.

The specific details of the coating K are not included in this application, as they are more fully described in co-pending patent application: Ser. No. 121,031 Filed Nov. 16, 1987 in the names of Joseph J. Hart, David C. Glasgow, and Richard W. Carpenter as co-inventors.

Although in the embodiment illustrated in FIGS. 1 through 5, only the outer surface of top wall panel 22 is provided with a coating K of electrically conductive material, if desired, other surfaces of the carton, both interior exterior, may be provided with such a coating.

Turning now to FIGS. 6 through 10 of the drawings, it will be seen that a slightly modified form of the invention is shown. Portions of the structure which correspond to related portions of the structure illustrated in the previously described views have been identified by related numerals.

The structure of this embodiment is very similar to that of the previous embodiment, except that the arcuate cut liens 127 in the side walls 112 are formed at the inner or lower ends of the side walls, so that the tabs 128 serve as extentions of bottom wall 110, rather than as extentions of retaining panels 120, as in the case of the previously described embodiment.

Also, in this embodiment the entire outer surface of the carton is provided with a coating K1, which is a discontinuous layer of electrically conductive material. This embodiment of the carton functions in substantially the same manner as the previously described embodiment.

Referring now to FIGS. 11 through 15, yet another embodiment of the invention is shown. Again, in this embodiment portions of the structure corresponding to related portions of the structures illustrated in the earlier views have been identified by related numerals.

In this embodiment, it will be seen that the cut lines 227 are rectangular in shape rather than arcuate and are formed in bottom wall 210, rather than in the side walls. The purpose of this, as best seen in FIGS. 12–15, is to provide tabs 228 which serve as feet for supporting the carton in such a manner that the bottom wall 222 is elevated from the surface upon which the carton is supported.

In addition to the cut lines 227 at the sides of the carton bottom wall, which form the tabs 228 projecting downwardly from the side walls 212, there are also provided cut lines 231 at opposite ends of bottom wall 210 which form tabs 232 extending downwardly from end walls 214. The tabs 232, like the tabs 228, serve as legs or feet to support the carton, so the bottom wall 210 is raised above the surface on which the carton is supported. Also, when the tabs 228 and 232 are folded out of the plane of bottom wall 210, vent openings 229 and 233, respectively, are formed in the bottom wall.

Thus, it will be appreciated that in each embodiment of the invention there is provided a carton of simple design and constuction which is relatively easy to fabricate and easy to erect manually. The carton includes an upper wall which is substantially larger in area than the bottom wall and is supported not only by the side and end walls of the carton, but by a pair of retaining walls which are joined to the upper edges of the carton side walls.

The enlarged surface area of the top wall, which is coated with a discontinuous layer of electrically conductive material, facilates the browning of the surface of an article of food supported on the carton in a microwave oven.

What is claimed is:

1. A disposable, collapsible, sleeve-type carton, coated on at least one surface thereof with a discontinuous layer of electrically conductive material and adapted to hold an item of food for browning a surface thereof when subjected to microwave radiation, said carton being formed from a unitary blank of foldable paperboard and comprising:

(a) top and bottom walls foldably joined to each other by opposed end walls to form a tubular structure open at the sides;

(b) said bottom wall having substantially the same length as but substantially less width than said top wall;

(c) said end walls being generally trapezoidal in shape and having parallel top and bottom edges and inclined side edges;

(d) a pair of side walls foldably joined to respective side edges of said bottom wall and extending upwardly to said top wall to close the sides of said tubular structure;

(e) each of said side walls being joined at each end thereof to a related end wall by a generally triangular web which is foldably joined along adjacent edges to an end edge of said side wall and to a side edge of a related end wall;

(f) each of said side walls having foldably joined to an upper edge thereof a retaining panel disposed to extend normal to said side wall and to underlie said top wall and provide additional support for said top wall;

(g) one of said bottom and side walls having at least one vent opening extending therethrough.

* * * * *